US009859600B2

(12) United States Patent
Kaneko et al.

(10) Patent No.: US 9,859,600 B2
(45) Date of Patent: Jan. 2, 2018

(54) SUBSTRATE HAVING CONDUCTIVE AND NON-CONDUCTIVE THROUGH HOLES FORMING A RESONANT PORTION USABLE AS A DIELECTRIC RESONATOR, FILTER AND DUPLEXER

(71) Applicant: NEC Corporation, Tokyo (JP)

(72) Inventors: Tomoya Kaneko, Tokyo (JP); Manabu Yoshida, Tokyo (JP)

(73) Assignee: NEC Corporation, Tokyo (JP)

( * ) Notice: Subject to any disclaimer, the term of this patent is extended or adjusted under 35 U.S.C. 154(b) by 81 days.

(21) Appl. No.: 14/761,593

(22) PCT Filed: Dec. 3, 2013

(86) PCT No.: PCT/JP2013/007083
§ 371 (c)(1),
(2) Date: Jul. 16, 2015

(87) PCT Pub. No.: WO2014/115213
PCT Pub. Date: Jul. 31, 2014

(65) Prior Publication Data

US 2015/0325903 A1 Nov. 12, 2015

(30) Foreign Application Priority Data

Jan. 24, 2013 (JP) ..... 2013-011297

(51) Int. Cl.
*H01P 1/20* (2006.01)
*H01P 1/208* (2006.01)
(Continued)

(52) U.S. Cl.
CPC ..... *H01P 1/2088* (2013.01); *H01P 1/2002* (2013.01); *H01P 1/2084* (2013.01);
(Continued)

(58) Field of Classification Search
CPC .. H01P 1/2088; H01P 1/2084; H01P 1/20318; H01P 7/10
(Continued)

(56) References Cited

U.S. PATENT DOCUMENTS

2002/0000899 A1 1/2002 Hiratsuka et al.
2002/0017968 A1 2/2002 Hiratsuka et al.
(Continued)

FOREIGN PATENT DOCUMENTS

EP 0966055 A1 12/1999
EP 1300908 A1 4/2003
(Continued)

OTHER PUBLICATIONS

El Matbouly, H., et al., "A Novel Chipless Identification Tag Based on a Substrate Integrated Cavity Resonator," IEEE Microwave and Wireless Components Letters, New York, NY, vol. 23, No. 1, pp. 52-54 (Jan. 1, 2013).
(Continued)

*Primary Examiner* — Benny Lee
(74) *Attorney, Agent, or Firm* — Wilmer Cutler Pickering Hale and Dorr LLP

(57) ABSTRACT

A first exemplary aspect of the present invention is a dielectric resonator including: a substrate (20) including a first conductor layer, a second conductor layer, and a dielectric layer formed between the first conductor layer and the second conductor layer, a plurality of conductive through holes (10) that penetrate the substrate (20) and are formed along a first annular line, and in which at least side walls are covered with a conductor, and a plurality of non-conductive through holes (11) that penetrate the substrate (20) and are formed along a second annular line prescribed inside the first
(Continued)

annular line, and in which side walls are covered with a non-conductor or the dielectric layer is exposed on the side walls.

5 Claims, 14 Drawing Sheets

(51) Int. Cl.
*H01P 7/10* (2006.01)
*H01P 5/12* (2006.01)
*H01P 1/213* (2006.01)

(52) U.S. Cl.
CPC ..... *H01P 7/10* (2013.01); *H01P 1/213* (2013.01); *H01P 5/12* (2013.01)

(58) Field of Classification Search
USPC ..... 333/219.1, 219
See application file for complete search history.

(56) References Cited

U.S. PATENT DOCUMENTS

| | | | | |
|---|---|---|---|---|
| 2003/0156806 | A1 | 8/2003 | Maruhashi et al. | |
| 2006/0132261 | A1 | 6/2006 | Sonoda et al. | |
| 2006/0152306 | A1* | 7/2006 | Ito et al. | H01P 7/00 333/219.1 |
| 2009/0091406 | A1* | 4/2009 | Kushta et al. | H01P 3/06 333/260 |
| 2011/0001584 | A1 | 1/2011 | Enokihara | |
| 2012/0293279 | A1* | 11/2012 | Gong et al. | H01P 1/208 333/202 |

FOREIGN PATENT DOCUMENTS

| | | | |
|---|---|---|---|
| JP | S62-71305 | A | 4/1987 |
| JP | 2002-026611 | A | 1/2002 |
| WO | WO-2005/006483 | A1 | 1/2005 |

OTHER PUBLICATIONS

Extended European Search Report issued by the European Patent Office for Application No. 13872343.2 dated Aug. 24, 2016 (13 pages).

Wu, L. S., et al., "Bandpass Filter Using Substrate Integrated Waveguide Cavity Loaded with Dielectric Rod," IEEE Microwave and Wireless Components Letters, New York, NY, vol. 19, No. 8, pp. 491-493 (Aug. 1, 2009).

International Search Report corresponding to PCT/JP2013/007083 dated Mar. 11, 2014 (one page).

European Office Action issued by the European Patent Office for European Application No. 13872343.2 dated Jun. 23, 2017 (7 pages).

Zelenchuk, D. and Fusco, V., "Dielectric characterisation of PCB materials using substrate integrated waveguide resonators," Microwave Conference (EUMC), 2010 European IEEE, pp. 1583-1586 (Sep. 28, 2010).

Zhou, L., et al., "Substrate Intgrated High-Q Dielectric Resonators for Low Phase Noise Oscillator," Electrical Design of Advanced Packaging & Systems Symposium, EDAPS, IEEE, pp. 1-4 (Dec. 2, 2009).

* cited by examiner

SUBSTRATE HAVING CONDUCTIVE AND NON-CONDUCTIVE THROUGH HOLES FORMING A RESONANT PORTION USABLE AS A DIELECTRIC RESONATOR, FILTER AND DUPLEXER

CROSS-REFERENCE TO RELATED APPLICATIONS

This application is a national stage application of International Application No. PCT/JP2013/007083 entitled "Dielectric Resonator, Dielectric Filter, and Dielectric Duplexer" filed on Dec. 3, 2013, which claims priority to Japanese Application No. 2013-011297 filed on Jan. 24, 2013, the disclosures of which are hereby incorporated by reference in their entirety.

TECHNICAL FIELD

The present invention relates to a dielectric resonator, a dielectric filter, and a dielectric duplexer and, in particular, to a dielectric resonator, a dielectric filter, and a dielectric duplexer that are formed on one substrate including a dielectric layer.

BACKGROUND ART

In radio equipment, such as a base station for cell phones, a filter circuit in which a resonator is connected in multiple stages is utilized. As this resonator, a resonator is utilized in which a columnar or a cylindrical dielectric resonator is housed in a metal case. However, there is a problem that such resonator has large volume. Meanwhile small dielectric resonators, each utilizing a dielectric substrate having a dielectric layer, are disclosed in Patent Literatures 1 and 2.

Patent Literature 1 discloses the dielectric resonator in which a pair of facing electrodes is formed on both main surfaces of the dielectric substrate, a plurality of through holes are provided between edges of the electrodes, and in which the electrodes are connected to each other through the through holes.

In addition, Patent Literature 2 discloses the resonator including the dielectric substrate and electrodes provided at both surfaces of the dielectric substrate, in which at least one of the electrodes of the surfaces is formed as a circular electrode. In Patent Literature 2, in the resonator, a plurality of through holes is provided in a penetrating manner along a periphery of the circular electrode in the dielectric substrate, an inside of the each through hole is set as an electrode non-forming portion in which the electrode is omitted, and open ends for enhancing electromagnetic field confinement are provided at the periphery of the circular electrode using the plurality of through holes. As a result of this, improvement in a Q value is achieved in the resonator described in Patent Literature 2.

CITATION LIST

Patent Literature

Patent Literature 1: Japanese Unexamined Patent Application Publication No. Sho 62-71305 published Apr. 2, 1987.

Patent Literature 2: International Patent Publication No. WO 2005/006483 published Jan. 20, 2005.

SUMMARY OF THE INVENTION

Technical Problem

However, in technologies described in Patent Literatures 1 and 2, there have been problems in that a size of the electrode on the substrate that functions as the resonator is limited, and that a multistage configuration cannot be employed since non-conductive through holes are arranged at an outer periphery.

An object of the present invention is to provide a dielectric resonator, a dielectric filter, and a dielectric duplexer that solve such problems.

Solution to the Problem

A first exemplary aspect of the present invention is a dielectric resonator including: a substrate including a first conductor layer, a second conductor layer, and a dielectric layer formed between the first conductor layer and the second conductor layer, a plurality of conductive through holes that penetrate the substrate and are formed along a first annular line, and in which at least side walls of the plurality of conductive through holes are covered with a conductor, and a plurality of non-conductive through holes that penetrate the substrate and are formed along a second annular line prescribed inside the first annular line, and in which side walls of the plurality of conductive through holes are covered with a non-conductor or the dielectric layer is exposed on the side walls.

In addition, a dielectric filter and a dielectric duplexer in accordance with the present invention are formed by providing a plurality of the above-described dielectric resonators on one substrate, and connecting the plurality of resonators through connection portions provided on the substrate on which the resonators are formed.

Advantageous Effects of the Invention

According to the dielectric resonator in accordance with the present invention, the resonator can be configured in multiple stages on one substrate.

DETAILED DESCRIPTION OF EXEMPLARY EMBODIMENTS

First Exemplary Embodiment

Hereinafter, embodiments of the present invention will be explained with reference to drawings, wherein like features in different drawing figures are denoted by the same reference numbers. A plurality of dielectric resonators in accordance with the present invention can be utilized by being connected in multiple stages to thereby be utilized as a dielectric filter or a dielectric duplexer. At this time, with the dielectric resonator in accordance with the present invention, the plurality of dielectric resonators connected in multiple stages on one substrate (for example, a dielectric substrate) can be formed. This is because the dielectric resonator in accordance with the present invention has a configuration to be able to be connected in multiple stages. Consequently, in a first exemplary embodiment, a configuration of the dielectric resonator as a single body in accordance with the present invention will be explained.

Figure 1:
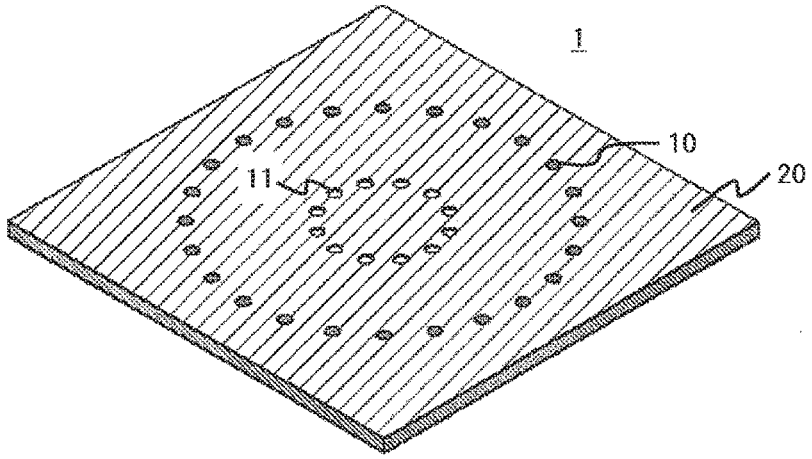
FIG. 1 is a perspective view of a dielectric resonator in accordance with a first exemplary embodiment.

A perspective view of a dielectric resonator 1 in accordance with the first exemplary embodiment is shown in FIG. 1. As shown in FIG. 1, in the dielectric resonator 1 in accordance with the first exemplary embodiment, a plurality of conductive through holes 10 and a plurality of non-conductive through holes 11 are formed in a substrate 20. Although details will be mentioned later, the substrate 20 is the one in which a first conductor layer is provided at a front surface side, a second conductor layer is provided at a back surface side, and in which a dielectric layer is provided between the first conductor layer and the second conductor layer.

The conductive through hole 10 is a through hole that penetrates the substrate 20, and in which at least a side wall of the through hole 10 is covered with a conductor. In the first exemplary embodiment, as the conductive through hole, a through hole is utilized whose side wall is, for example, covered with a conductor of the same material amount as the first and the second conductor layers of the substrate 20. Note that the conductive through hole 10 may be filled with the conductor. Additionally, the plurality of conductive through holes 10 are formed along a first annular line. The first annular line is set to have a circular shape in the first exemplary embodiment. In addition, although not clearly shown in FIG. 1, the first annular line is prescribed along an inside of a region in which the conductive through holes 10 are formed.

A non-conductive through hole 11 is a through hole that penetrates the substrate 20, and in which side wall of through hole 11 is covered with a non-conductor or a dielectric layer is exposed on the side wall. In the first exemplary embodiment, as the non-conductive through hole 11, a through hole is utilized whose side wall is formed so that the dielectric layer of the substrate 20 is exposed on the side wall. Note that the side wall of the non-conductive through hole 11 may be covered with a non-conductive member. Additionally, the plurality of non-conductive through holes 11 are formed along a second annular line prescribed inside the first annular line. The second annular line is set to have a circular shape in the first exemplary embodiment. That is, the first annular line and the second annular line have similar shapes. In addition, although not clearly shown in FIG. 1, the second annular line is prescribed along an inside of a region in which the non-conductive through holes 11 are formed.

Figure 2:
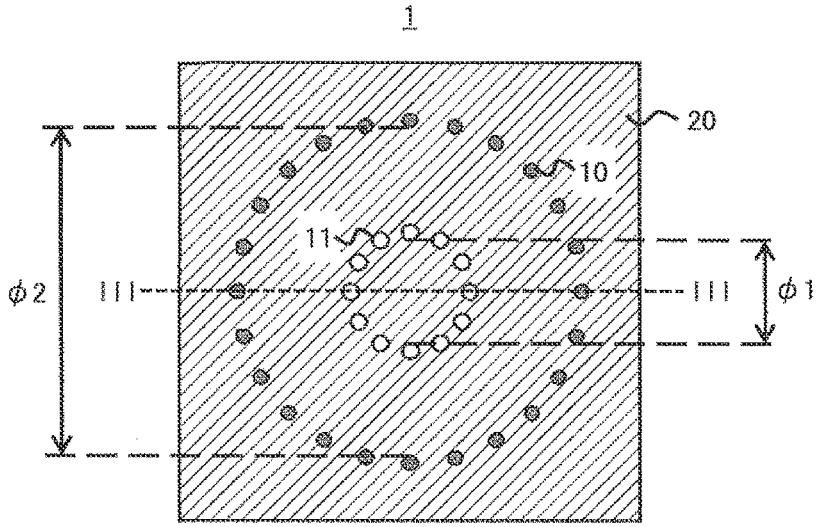
FIG. 2 is a top view of the dielectric resonator in accordance with the first exemplary embodiment.

Subsequently, a top view of the dielectric resonator 1 in accordance with the first exemplary embodiment is shown in FIG. 2. As shown in FIG. 2, in the dielectric resonator 1, when an inner diameter of the first annular line along which the plurality of conductive through holes 10 are formed is set as $\Phi 2$, and an inner diameter of the second annular line along which the plurality of non-conductive through holes 11 are formed is set as $\Phi 1$, a relation between the two annular lines is $\Phi 1 < \Phi 2$.

Figure 3:
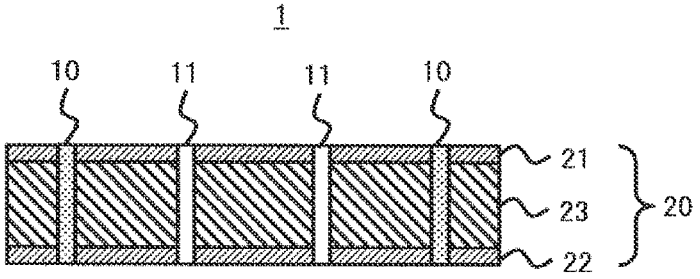
FIG. 3 is a cross-sectional view of the dielectric resonator in accordance with the first exemplary embodiment.

Subsequently, a cross-sectional view of the dielectric resonator 1 in accordance with the first exemplary embodiment is shown in FIG. 3. An example shown in FIG. 3 shows a cross section along a line III-III of the dielectric resonator 1 shown in FIG. 2. As shown in FIG. 3, the substrate 20 of the dielectric resonator 1 has a first conductor layer 21, a second conductor layer 22, and a dielectric layer 23. The first conductor layer 21 is formed at the front surface side of the substrate 20. The second conductor layer 22 is formed at the back surface side of the substrate 20. The dielectric layer 23 is provided in a region sandwiched between the first conductor layer 21 and the second conductor layer 22.

Additionally, the conductive through holes 10 and the non-conductive through holes 11 are formed so as to penetrate the substrate 20. Here, in the first exemplary embodiment, the side wall of the conductive through hole 10 is covered with a member of the same material as the first conductor layer 21 and the second conductor layer 22. As a result of this, the first conductor layer 21 and the second conductor layer 22 become electrically connected to each other through the conductive holes 10. In addition, the side walls of the non-conductive through holes 11 expose dielectric layer 23.

In the dielectric resonator 1 in accordance with the first exemplary embodiment, the resonator is formed by means of the above-described configuration, and thus a size of an electrode formed by the first conductor layer 21 and the second conductor layer 22 is not limited. In addition, in the dielectric resonator 1 in accordance with the first exemplary embodiment, the plurality of conductive through holes 10 are provided along the first annular line, and thereby a signal can be confined in a region surrounded by the conductive through holes 10. Additionally, in the first exemplary embodiment, the region surrounded by the plurality of non-conductive through holes 11 formed in the region surrounded by the conductive through holes 10 can be made to function as the resonator.

Figure 4:
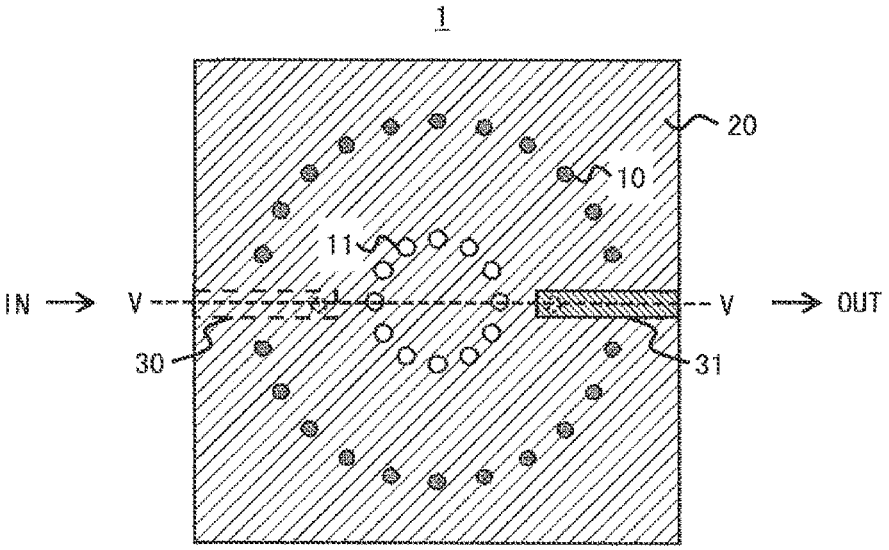
FIG. 4 is a top view showing an arrangement example of the microstrip wirings and the coupled antennas of the dielectric resonator in accordance with the first exemplary embodiment.

In the dielectric resonator 1 in accordance with the first exemplary embodiment, input/output of a signal to the resonator is performed through microstrip wirings and coupled antennas connected to the microstrip wirings. Consequently, arrangement of the microstrip wirings and the coupled antennas will be explained hereinafter. In FIG. 4, there is shown a top view showing an arrangement example of the microstrip wirings and the coupled antennas of the dielectric resonator 1 in accordance with the first exemplary embodiment.

The microstrip wiring can be formed as an internal wiring of the substrate 20, or a front wiring provided on the front surface of the substrate 20. Consequently, in FIG. 4, the example is shown in which a microstrip wiring 30 of an input side (IN) is formed by the internal wiring, and in which a microstrip wiring 31 of an output side (OUT) is formed by the front wiring.

Figure 5:
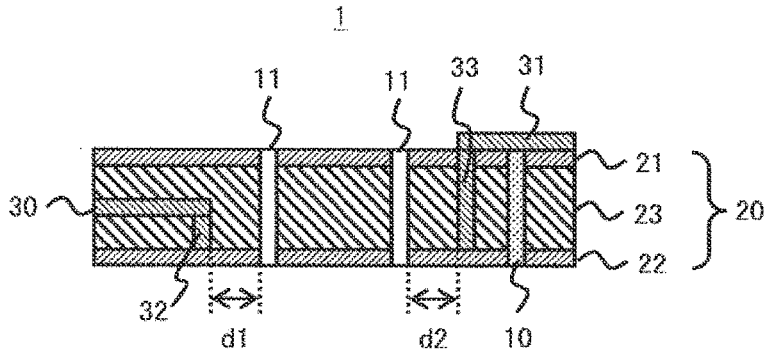
FIG. 5 is a cross-sectional view of the dielectric resonator in accordance with the first exemplary embodiment.

Subsequently, in FIG. 5, there is shown a cross-sectional view of the dielectric resonator 1 in accordance with the first exemplary embodiment, the cross-sectional view being taken along a line V-V of the top view shown in FIG. 4. As shown in FIG. 5, the microstrip wiring 30 is formed in the dielectric layer 23. The microstrip wiring 30 is formed so as to extend from an outside of a first region in which the conductive through holes 10 are formed to a third region between the first region in which the conductive through holes 10 are formed and a second region in which the non-conductive through holes 11 are formed. Additionally, a coupled antenna 32 is provided near an end of the microstrip wiring 30. The coupled antenna 32 has a rod-like shape, and is formed by a conductor. The coupled antenna 32 is connected to the microstrip wiring 30. In addition, a coupling coefficient of the coupled antenna 32 and the resonator is calculated based on a length of a distance d1 between the coupled antenna 32 and the non-conductive through holes 11.

In addition, the microstrip wiring 31 is formed on the front surface of the substrate 20. The microstrip wiring 31 is formed so as to extend from the third region between the first region in which the conductive through holes 10 are formed and the second region in which the non-conductive through holes 11 are formed to an outside of the first region in which the conductive through holes 10 are formed. Additionally, a coupled antenna 33 is provided near an end of the microstrip wiring 31. The coupled antenna 33 has a rod-like shape, and is formed by a conductor. The coupled antenna 33 is connected to the microstrip wiring 31. In addition, a coupling coefficient of the coupled antenna 33 and the resonator is calculated based on a length of a distance d2 between the coupled antenna 33 and the non-conductive through holes 11.

Subsequently, characteristics of the dielectric resonator 1 in accordance with the first exemplary embodiment will be explained. Here, there will be explained the characteristics of the dielectric resonator 1 in a case where the inner diameter φ2 of the first annular line is set to be 29 mm, the inner diameter φ1 of the second annular line is 17 mm, inner diameters of the conductive through hole 10 and the non-conductive through hole 11 are 1.5 mm, and where the substrate 20 is set to be a square whose one side has a length of 40 mm.

Note that a resonance frequency can be made low by increasing the inner diameter φ1 of the second annular line, and that the resonance frequency can be made high by decreasing the inner diameter φ1. In addition, a Q value can be increased by increasing a difference between the inner diameter φ1 and the inner diameter φ2. That is, a difference between a fundamental mode (for example, a fundamental wave) and a higher mode (for example, a higher harmonic wave not less than a secondary mode) can be increased by increasing the difference between the inner diameter φ1 and the inner diameter φ2.

Figure 6:
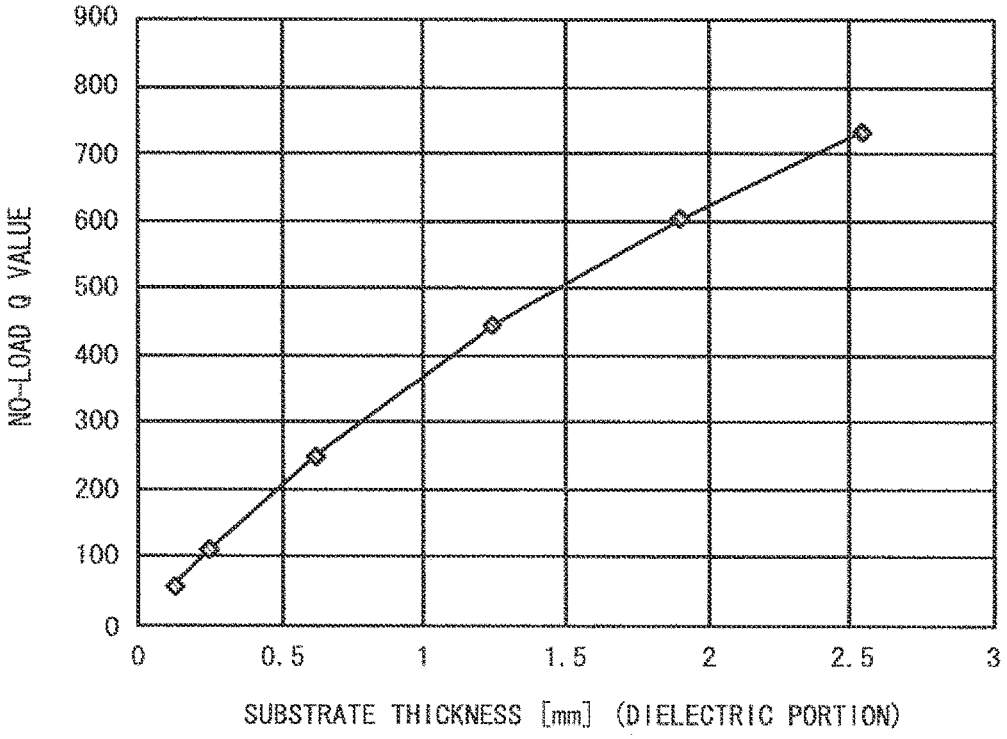
FIG. 6 is a graph showing characteristics of a Q value with respect to the substrate thickness of the dielectric resonator in accordance with the first exemplary embodiment.

In FIG. 6, there is shown a graph showing variations of a no-load Q value when a thickness (hereinafter referred to as a substrate thickness in mm) of the dielectric layer 23 of the substrate 20 is changed. As shown in FIG. 6, in the dielectric resonator 1 in accordance with the first exemplary embodiment, the Q value can be more increased as the substrate thickness is more increased.

Figure 7:
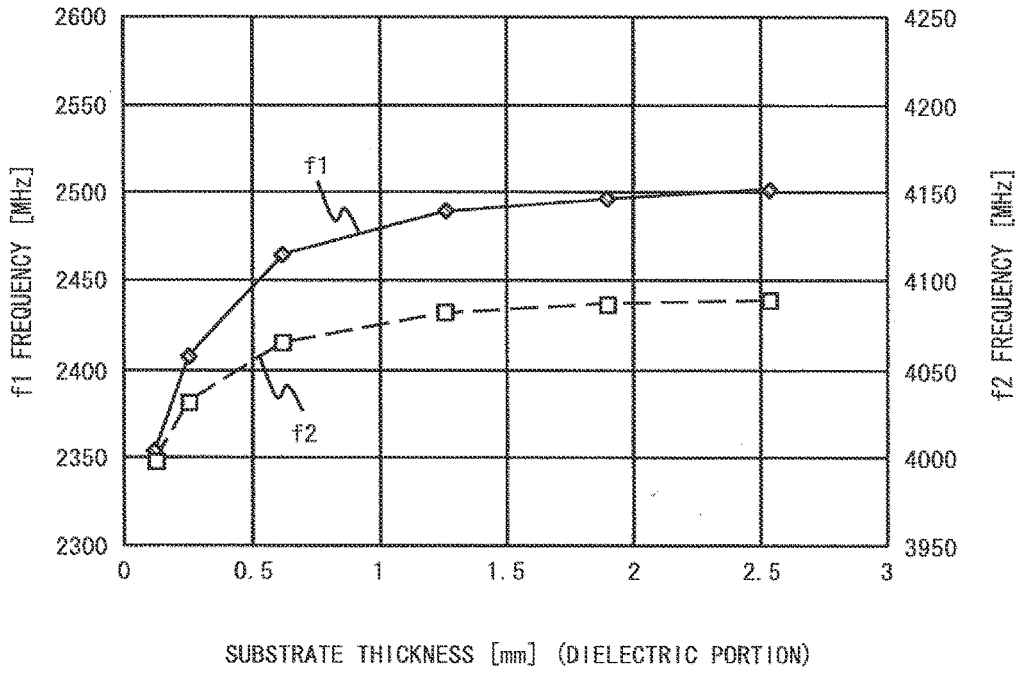
FIG. 7 is a graph showing the characteristics of the resonance frequency with respect to the substrate thickness of the dielectric resonator in accordance with the first exemplary embodiment.

In FIG. 7, there is shown a graph showing variations of a frequency f1 in GHz of a fundamental wave and a frequency f2 in GHz of a secondary higher harmonic wave when the substrate thickness in mm of the substrate 20 is changed. As shown in FIG. 7, in the dielectric resonator 1 in accordance with the first exemplary embodiment, although a resonance frequency of the frequency f1 of the fundamental wave and the frequency f2 of the secondary higher harmonic wave can be more increased as the substrate thickness is more increased, the resonance frequency changes so as to be asymptotic to a constant frequency. In an example shown in FIG. 7, change of the resonance frequency becomes small even if the substrate thickness is set to be not less than 2 mm.

By the above-described explanation, the dielectric resonator 1 in accordance with the first exemplary embodiment can achieve a dielectric resonator having no limitation in size of the electrode. In addition, in the dielectric resonator 1 in accordance with the first exemplary embodiment, a size of the resonator is prescribed by the inner diameter of the first annular line along which conductive through holes 10 are arranged. That is, the dielectric resonator 1 in accordance with the first exemplary embodiment is used, and thereby it becomes possible to make the plurality of resonators operate by a common electrode, even though the plurality of resonators are provided on the one substrate 20. In addition, the dielectric resonator 1 in accordance with the first exemplary embodiment is used, and thereby a dielectric filter or a dielectric duplexer can be configured by connecting the plurality of resonators in multiple stages within the one substrate 20.

In addition, since the dielectric resonator 1 in accordance with the first exemplary embodiment is formed by providing the conductive through holes 10 and the non-conductive through holes 11 in the substrate 20, the resonator can be achieved with small volume. In addition, as shown in FIGS. 6 and 7, in the dielectric resonator 1 in accordance with the first exemplary embodiment, the resonator can be achieved with a thin substrate thickness, and thus reduction in thickness of the resonator can be achieved.

Second Exemplary Embodiment

Figure 8:
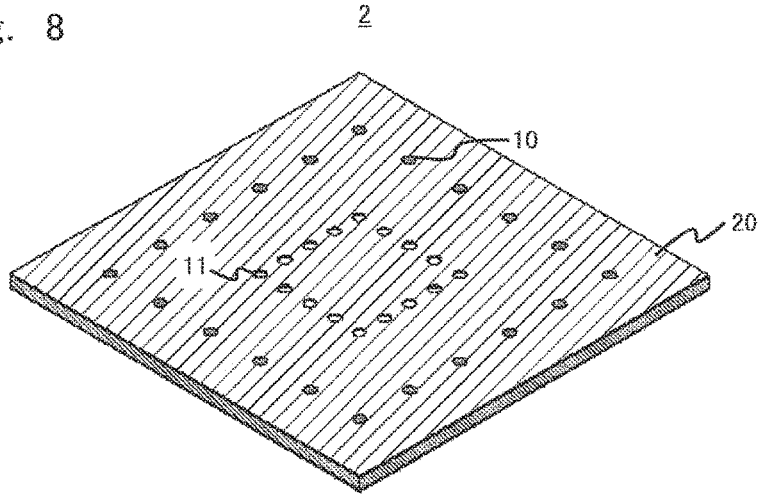
FIG. 8 is a perspective view of a dielectric resonator in accordance with a second exemplary embodiment.

Another mode of the first annular line and the second annular line of the dielectric resonator 1 in accordance with the first exemplary embodiment will be explained in a second exemplary embodiment. Consequently, a perspective view of a dielectric resonator 2 in accordance with the second exemplary embodiment is shown in FIG. 8. In addition, a top view of the dielectric resonator 2 in accordance with the second exemplary embodiment is shown in FIG. 9.

Figure 9:
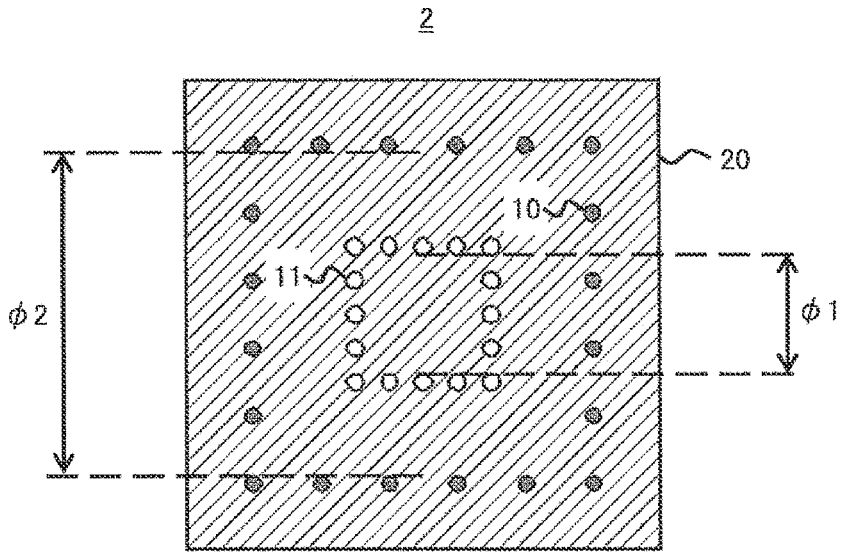
FIG. 9 is a top view of the dielectric resonator in accordance with the second exemplary embodiment.

As shown in FIGS. 8 and 9, in the dielectric resonator 2 in accordance with the second exemplary embodiment, the first annular line that prescribes an inner diameter of the first region in which the plurality of conductive through holes 10 are formed, and the second annular line that prescribes an inner diameter of the second region in which the plurality of non-conductive through holes 11 are formed have polygonal shapes (quadrangles in an example shown in FIGS. 8 and 9). Note that the shapes of the first annular line and the second annular line may just be polygons and, for example, may be hexagons or octagons.

In the dielectric resonator 2 in accordance with the second exemplary embodiment, although the shapes of the first annular line and the second annular line are polygons, a resonance frequency can be set by a size of the inner diameter φ1 of the second annular line, and a Q value of the resonator can be adjusted by a size of the inner diameter φ2 of the first annular line as shown in FIG. 9.

By the above-described explanation, it turns out that a dielectric resonator similar to the dielectric resonator 1 in accordance with the first exemplary embodiment can be achieved, even if the shapes of the first and the second annular lines of the dielectric resonator 1 in accordance with the first exemplary embodiment are not limited to circles but are polygons.

Third Exemplary Embodiment

Figure 10:
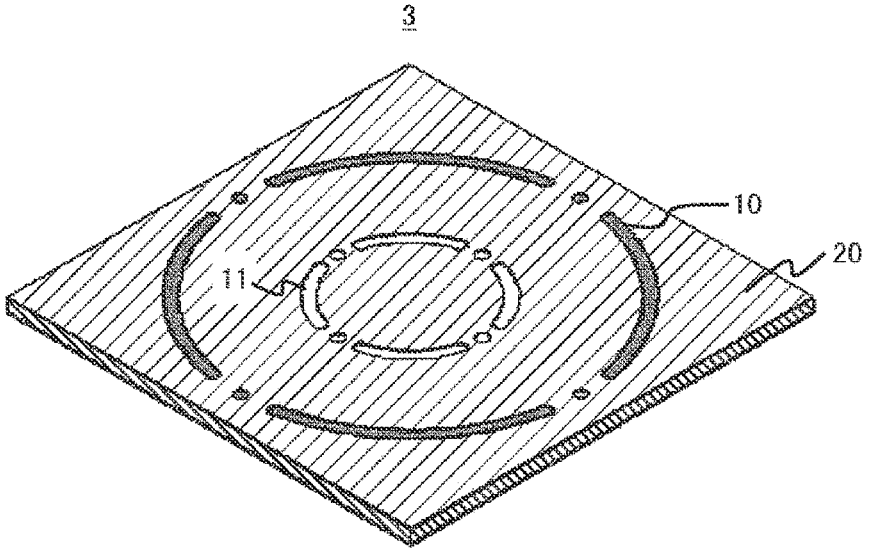
FIG. 10 is a perspective view of a dielectric resonator in accordance with a third exemplary embodiment.

Another mode of the conductive through holes 10 and the non-conductive through holes 11 of the dielectric resonator 1 in accordance with the first exemplary embodiment will be explained in a third exemplary embodiment. Consequently, a perspective view of a dielectric resonator 3 in accordance with the third exemplary embodiment is shown in FIG. 10. In addition, a top view of the dielectric resonator 3 in accordance with the third exemplary embodiment is shown in FIG. 11.

Figure 11:
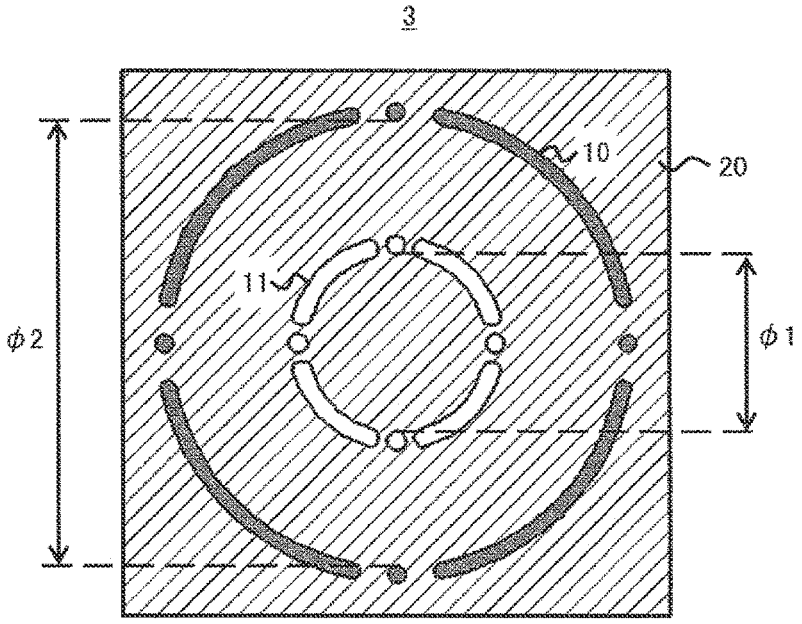
FIG. 11 is a top view of the dielectric resonator in accordance with the third exemplary embodiment.

As shown in FIGS. 10 and 11, in the dielectric resonator 3 in accordance with the third exemplary embodiment, some of the conductive through holes 10 are formed in slit shapes in which the plurality of through holes have been coupled to each other. In addition, in the dielectric resonator 3 in accordance with the third exemplary embodiment, also regarding the non-conductive through holes 11, some of them are formed in slit shapes in which the plurality of non-conductive through holes have been coupled to each other. Here, also in the dielectric resonator 3, the conductive through hole 10 and the non-conductive through hole 11 need to be formed by being divided into the plurality of through holes. This is because if a region surrounded by the non-conductive through holes that functions as a resonance portion, and a region outside the conductive through holes 10 are not formed as continuous electrode and dielectric, the resonator cannot be configured in multiple stages in the one substrate 20.

By the above-described explanation, it turns out that a dielectric resonator similar to the dielectric resonator 1 in accordance with the first exemplary embodiment can be achieved, even if some of the conductive through holes 10 and the non-conductive through holes 11 of the dielectric resonator 1 in accordance with the first exemplary embodiment have slit shapes.

Fourth Exemplary Embodiment

Figure 12:
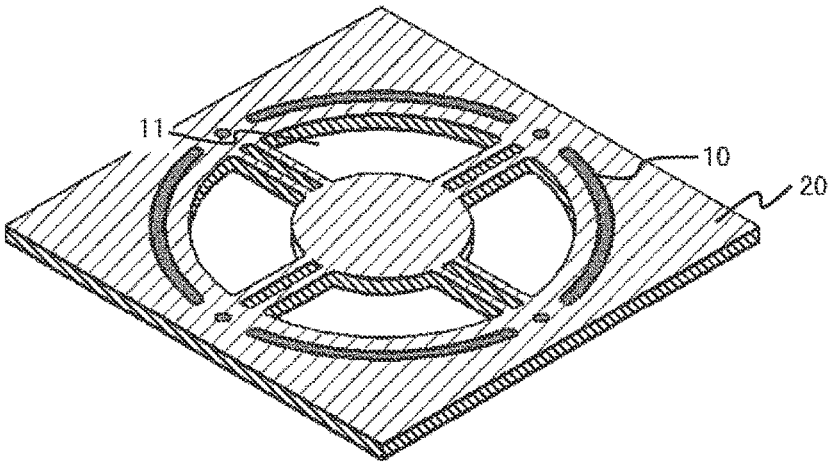
FIG. 12 is a perspective view of a dielectric resonator in accordance with a fourth exemplary embodiment.

Another mode of the conductive through holes 10 and the non-conductive through holes 11 of the dielectric resonator 1 in accordance with the first exemplary embodiment will be explained in a fourth exemplary embodiment. Consequently, a perspective view of a dielectric resonator 4 in accordance with the fourth exemplary embodiment is shown in FIG. 12. In addition, a top view of the dielectric resonator 4 in accordance with the fourth exemplary embodiment is shown in FIG. 13.

Figure 13:
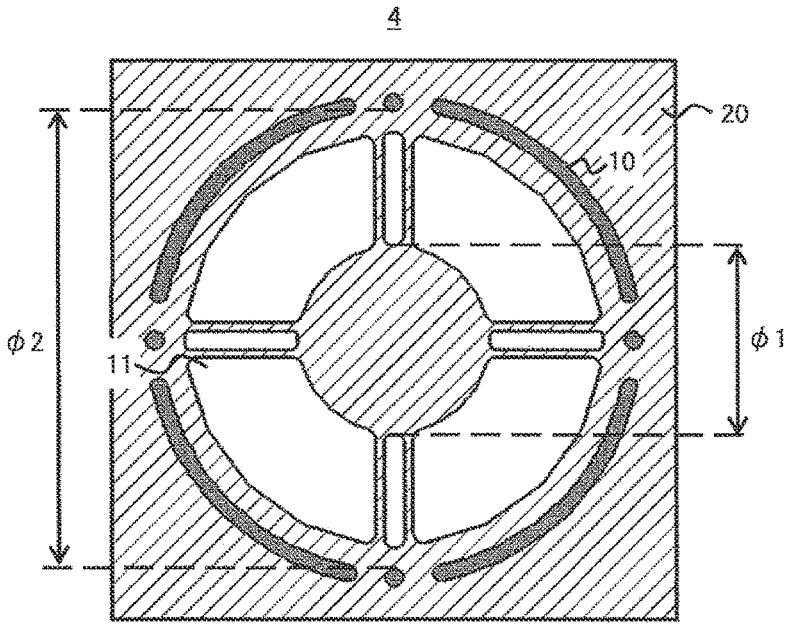
FIG. 13 is a top view of the dielectric resonator in accordance with the fourth exemplary embodiment.

As shown in FIGS. 12 and 13, in the dielectric resonator 4 in accordance with the fourth exemplary embodiment, some of the conductive through holes 10 are formed in slit shapes in which the plurality of through holes have been coupled to each other. In addition, the dielectric resonator 4 in accordance with the fourth exemplary embodiment has conductive through holes formed in the slit shapes, and non-conductive through holes formed in fan shapes. In the dielectric resonator 4, the second annular line that prescribes the region surrounded by the plurality of non-conductive through holes has a circular shape. Also in the dielectric resonator 4, the conductive through hole 10 and the non-conductive through hole 11 need to be formed by being divided into the plurality of through holes. This is because if the region surrounded by the non-conductive through holes that functions as the resonance portion, and the region outside the conductive through holes 10 are not formed as the continuous electrode and dielectric, the resonator cannot be configured in multiple stages in the one substrate 20.

By the above-described explanation, it turns out that a dielectric resonator similar to the dielectric resonator 1 in accordance with the first exemplary embodiment can be achieved, even if some of the conductive through holes 10 and the non-conductive through holes 11 of the dielectric resonator 1 in accordance with the first exemplary embodiment have slit shapes or fan shapes.

Fifth Exemplary Embodiment

Figure 14:
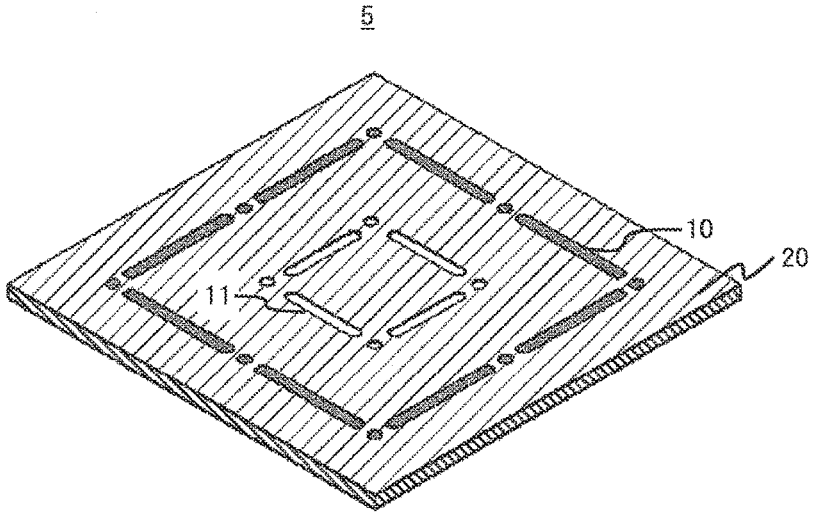
FIG. 14 is a perspective view of a dielectric resonator in accordance with a fifth exemplary embodiment.

Another mode of the conductive through holes 10 and the non-conductive through holes 11 of the dielectric resonator 2 in accordance with the second exemplary embodiment will be explained in a fifth exemplary embodiment. Consequently, a perspective view of a dielectric resonator 5 in accordance with the fifth exemplary embodiment is shown in FIG. 14. In addition, a top view of the dielectric resonator 5 in accordance with the fifth exemplary embodiment is shown in FIG. 15.

Figure 15:
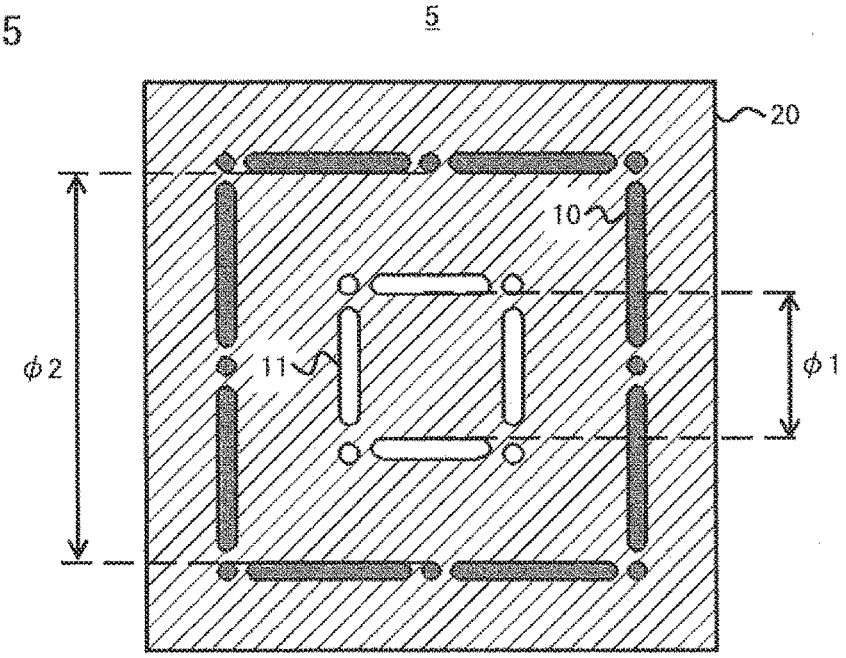
FIG. 15 is a top view of the dielectric resonator in accordance with the fifth exemplary embodiment.

As shown in FIGS. 14 and 15, in the dielectric resonator 5 in accordance with the fifth exemplary embodiment, some of the conductive through holes 10 are formed in slit shapes in which the plurality of through holes have been coupled to each other. In addition, in the dielectric resonator 5 in accordance with the fifth exemplary embodiment, also regarding the non-conductive through holes 11, some of them are formed in slit shapes in which the plurality of non-conductive through holes have been coupled to each other. Here, also in the dielectric resonator 5, the conductive through hole 10 and the non-conductive through hole 11 need to be formed by being divided into the plurality of through holes. This is because if the region surrounded by the non-conductive through holes that functions as the resonance portion, and the region outside the conductive through holes 10 are not formed as the continuous electrode and dielectric, the resonator cannot be configured in multiple stages in the one substrate 20.

By the above-described explanation, it turns out that a dielectric resonator similar to the dielectric resonator 2 in accordance with the second exemplary embodiment can be achieved, even if some of the conductive through holes 10 and the non-conductive through holes 11 of the dielectric resonator 2 in accordance with the second exemplary embodiment have slit shapes.

Sixth Exemplary Embodiment

Figure 16:
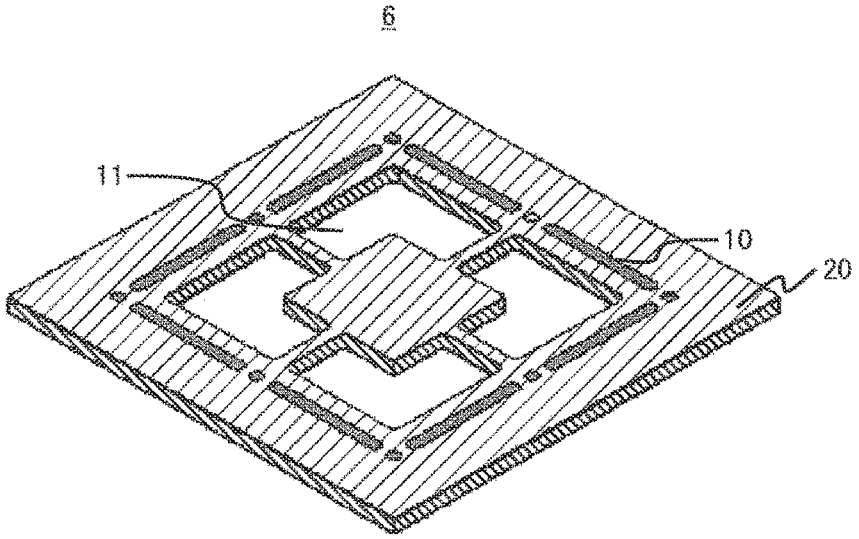
FIG. 16 is a perspective view of a dielectric resonator in accordance with a sixth exemplary embodiment.

Another mode of the conductive through holes 10 and the non-conductive through holes 11 of the dielectric resonator 2 in accordance with the second exemplary embodiment will be explained in an sixth exemplary embodiment. Consequently, a perspective view of a dielectric resonator 6 in accordance with the sixth exemplary embodiment is shown in FIG. 16. In addition, a top view of the dielectric resonator 6 in accordance with the sixth exemplary embodiment is shown in FIG. 17.

Figure 17:
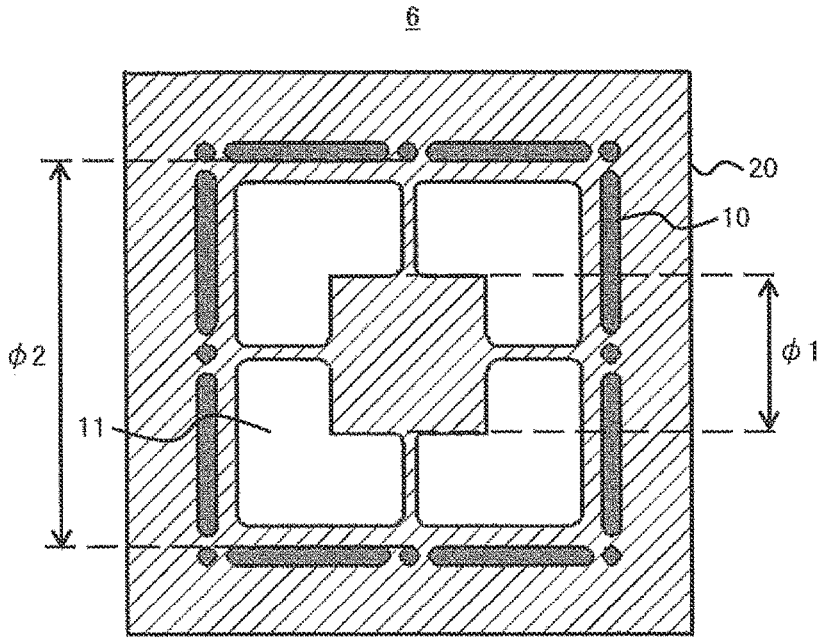
FIG. 17 is a top view of the dielectric resonator in accordance with the sixth exemplary embodiment.

As shown in FIGS. 16 and 17, in the dielectric resonator 6 in accordance with the sixth exemplary embodiment, some of the conductive through holes 10 are formed in slit shapes in which the plurality of through holes have been coupled to each other. In addition, the dielectric resonator 6 in accordance with the sixth exemplary embodiment has conductive through holes formed in the slit shapes, and non-conductive through holes formed in L-shapes. In the dielectric resonator 6, the second annular line that prescribes the region surrounded by the plurality of non-conductive through holes has a polygonal shape (for example, a quadrangle). Also in the dielectric resonator 6, the conductive through hole 10 and the non-conductive through hole 11 need to be formed by being divided into the plurality of through holes. This is because if the region surrounded by the non-conductive through holes that functions as a resonance portion, and the region outside the conductive through holes 10 are not formed as the continuous electrode and dielectric, the resonator cannot be configured in multiple stages in the one substrate 20.

By the above-described explanation, it turns out that a dielectric resonator similar to the dielectric resonator 2 in accordance with the second exemplary embodiment can be achieved, even if some of the conductive through holes 10 and the non-conductive through holes 11 of the dielectric resonator 3 in accordance with the sixth exemplary embodiment have slit shapes or L-shapes.

Seventh Exemplary Embodiment

A dielectric filter 7 utilizing the dielectric resonator 1 in accordance with the first exemplary embodiment will be explained in a seventh exemplary embodiment. Consequently, a perspective view of the dielectric filter 7 in accordance with the seventh exemplary embodiment is shown in FIG. 18, and a top view of the dielectric filter 7 is shown in FIG. 19.

Figure 18:
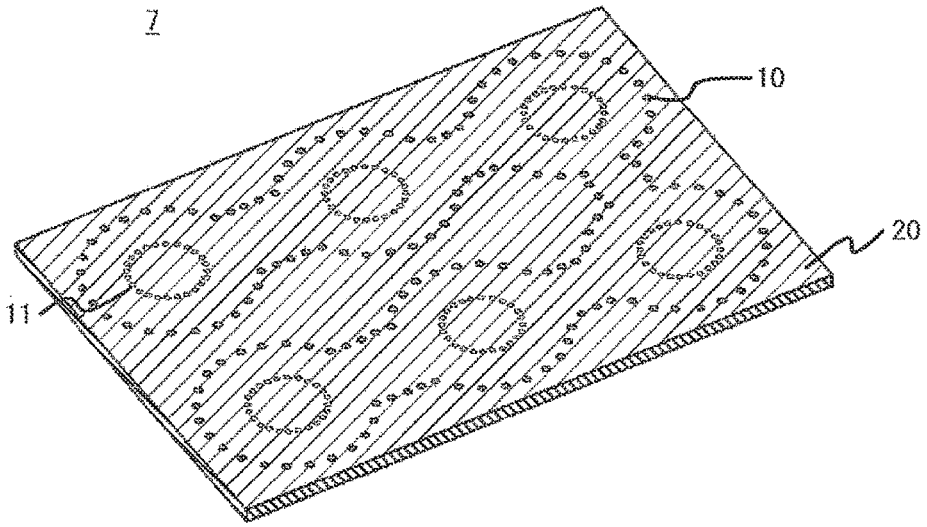
FIG. 18 is a perspective view of a dielectric resonator in accordance with a seventh exemplary embodiment.

As shown in FIG. 18, in the dielectric filter 7 in accordance with the seventh exemplary embodiment, there are formed a plurality of resonance portions formed by a set of the plurality of conductive through holes 10 and the plurality of non-conductive through holes 11. In addition, in the dielectric filter 7, the resonance portion is connected in multiple stages.

Figure 19:
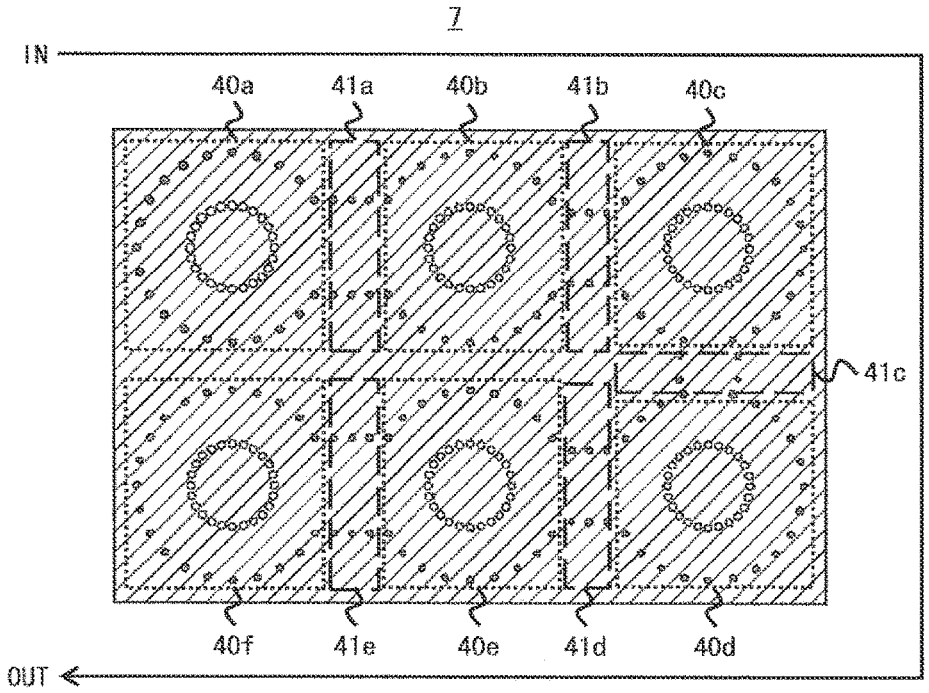
FIG. 19 is a top view of the dielectric resonator in accordance with the seventh exemplary embodiment.

Reference characters 40*a*, 40*b*, 40*c*, 40*d*, 40*e*, and 40*f* are attached to the resonance portions in FIG. 19. In the dielectric filter 7 in accordance with the seventh exemplary embodiment, a first resonance portion and a second resonance portion adjacent to each other among the resonance portions 40*a*, 40*b*, 40*c*, 40*d*, 40*e*, and 40*f* have openings in which the conductive through holes are not formed, the openings being located in parts of facing regions. Additionally, the dielectric filter 7 has connection portions 41*a*, 41*b*, 41*c*, 41*d*, and 41*e* that connect the opening of the first resonance portion and the opening of the second resonance portion, and in which the plurality of conductive through holes are formed along a first and a second connection lines arranged with widths narrower than a width of the first annular line. In an example shown in FIG. 19, the connection portion 41*a* connects the resonance portions 40*a* and 40*b*. The connection portion 41*b* connects the resonance portions 40*b* and 40*c*. The connection portion 41*c* connects the resonance portions 40*c* and 40*d*. The connection portion 41*d* connects the resonance portions 40*d* and 40*e*. The connection portion 41*e* connects the resonance portions 40*e* and 40*f*.

In the example shown in FIG. 19, a signal is input (IN) to the dielectric filter 7 from the resonance portion 40*a*, and the dielectric filter 7 outputs (OUT) a signal from the resonance portion 40*f*. In addition, in the dielectric filter 7, a coupling coefficient between the resonance portions can be adjusted by adjusting widths and lengths of the connection portions 41*a*, 41*b*, 41*c*, 41*d*, and 41*e*.

By the above-described explanation, by using the dielectric resonator 1 in accordance with the first exemplary embodiment, the plurality of resonators are arranged on the one substrate 20, and the plurality of resonators are connected in multiple stages, thereby enabling to configure the dielectric filter. This is because in the dielectric resonator 1 in accordance with the first exemplary embodiment, there is no limitation in size of the electrode, and because the same electrode can be used for the plurality of resonators. According to the dielectric filter 7 in accordance with the seventh exemplary embodiment, since the dielectric filter can be configured on the one substrate 20, reduction in area and thickness of the dielectric filter can be achieved.

Eighth Exemplary Embodiment

A dielectric duplexer 8 utilizing the dielectric resonator 1 in accordance with the first exemplary embodiment will be explained in an eighth exemplary embodiment. Consequently, a perspective view of the dielectric duplexer 8 in accordance with the eighth exemplary embodiment is shown in FIG. 20, and a top view of the dielectric duplexer 8 is shown in FIG. 21.

Figure 20:
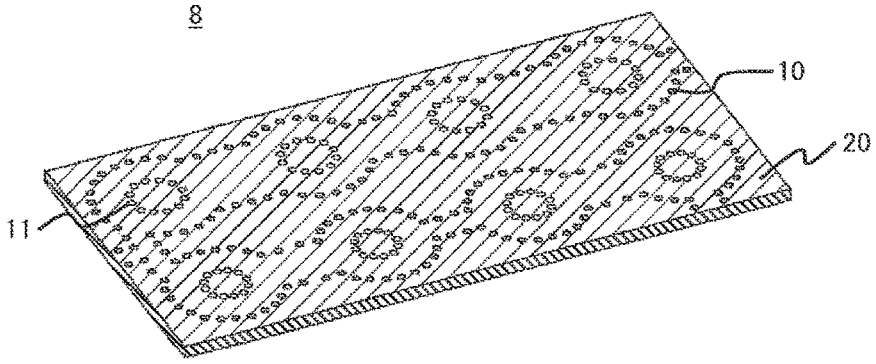
FIG. 20 is a perspective view of a dielectric resonator in accordance with a eighth exemplary embodiment.

As shown in FIG. 20, in the dielectric duplexer 8 in accordance with the eighth exemplary embodiment, two sets of dielectric filters are formed on the one substrate 20. Additionally, in the two sets of dielectric filters, a plurality of resonance portions each of which is formed by a set of the plurality of conductive through holes 10 and the plurality of non-conductive through holes 11 are formed. In addition, the resonance portion is connected in multiple stages in the respective dielectric filters.

Figure 21:
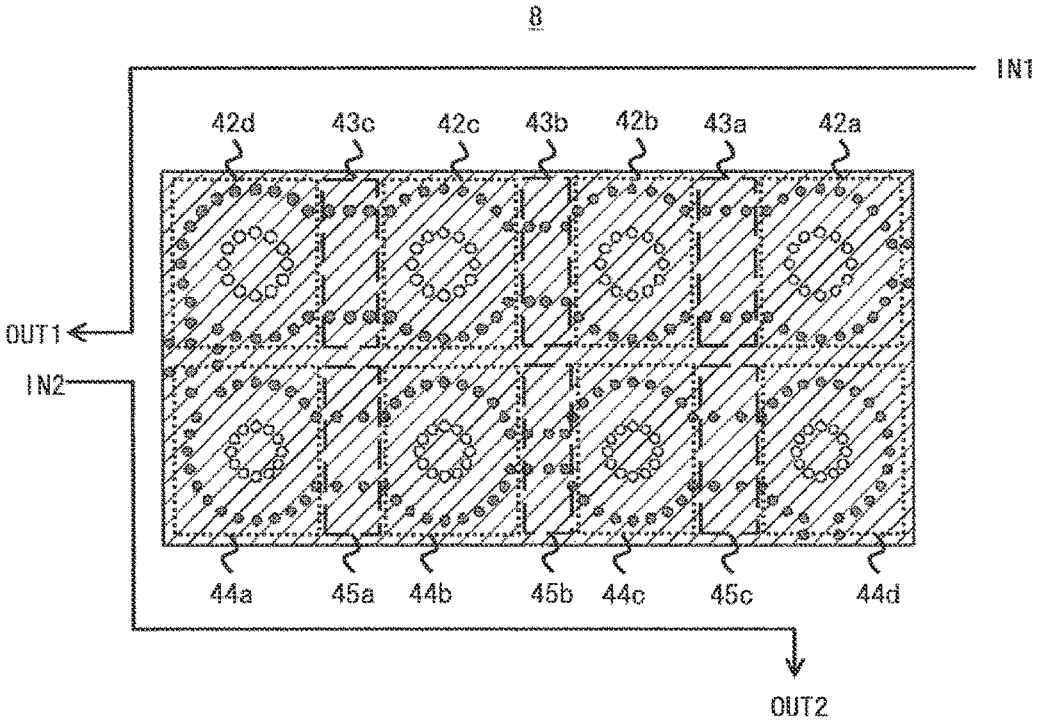
FIG. 21 is a top view of the dielectric resonator in accordance with the eighth exemplary embodiment.

In addition, as shown in FIG. 21, in the dielectric duplexer 8 in accordance with the eighth exemplary embodiment, a first dielectric filter (for example, a transmission dielectric filter) is configured by resonance portions 42*a*, 42*b*, 42*c*, and 42*d*, and a second dielectric filter (for example, a reception dielectric filter) is configured by resonance portions 44*a*, 44*b*, 44*c*, and 44*d*. In addition, respectively in the transmission dielectric filter and the reception dielectric filter, a first resonance portion and a second resonance portion adjacent to each other among the plurality of resonance portions have openings in which the conductive through holes are not formed, the openings being located in parts of facing regions. Additionally, the dielectric duplexer 8 has connection portions that connect the opening of the first resonance portion and the opening of the second resonance portion, and in which the plurality of conductive through holes are formed along a first and a second connection lines arranged with widths narrower than the width of the first annular line. In an example shown in FIG. 21, a connection portion 43*a* connects the resonance portions 42*a* and 42*b*. A connection portion 43*b* connects the resonance portions 42*b* and 42*c*. A connection portion 43*c* connects the resonance portions 42*c* and 42*d*. A connection portion 45*a* connects the resonance portions 44*a* and 44*b*. A connection portion 45*b* connects the resonance portions 44*b* and 44*c*. A connection portion 45*c* connects the resonance portions 44*c* and 44*d*.

In addition, as shown in FIG. 21, in the dielectric duplexer 8, the resonance portions arranged at one ends of the plurality of dielectric filters each have a coupled antenna connected to one microstrip wiring, and the resonance portions arranged at other ends thereof each have a coupled antenna connected to a different microstrip wiring. Note that although coupled antennas are not clearly shown in FIG. 21, the resonance portion 42*a* has a coupled antenna and a microstrip wiring through which a transmission input signal IN1 is transmitted, and the resonance portion 42*d* has a coupled antenna and a microstrip wiring through which a transmission output signal OUT1 is transmitted. In addition, the resonance portion 44*a* has a coupled antenna and a microstrip wiring through which a reception input signal IN2 is transmitted, and the resonance portion 44*d* has a coupled antenna and a microstrip wiring through which a reception output signal OUT2 is transmitted. Additionally, a microstrip wiring to which the coupled antenna of the resonance portion 42*d* and the coupled antenna of the resonance portion 44*a* are connected is shared by the transmission output signal OUT1 and the reception input signal IN1.

In addition, in the dielectric duplexer 8, a coupling coefficient between the resonance portions can be adjusted by adjusting widths and lengths of the connection portions 43*a* to 43*c* and 45*a* to 45*c*.

By the above-described explanation, by using the dielectric resonator 1 in accordance with the first exemplary embodiment, the plurality of resonators are arranged on the one substrate 20, and the plurality of resonators are connected in multiple stages, thereby enabling to configure the plurality of dielectric filters. This is because in the dielectric resonator 1 in accordance with the first exemplary embodiment, there is no limitation in size of the electrode, and the same electrode can be used for the plurality of resonators. According to the dielectric duplexer 8 in accordance with the eighth exemplary embodiment, since the dielectric duplexer can be configured on the one substrate 20, reduction in area and thickness of the dielectric duplexer can be achieved.

Ninth Exemplary Embodiment

Figure 22:
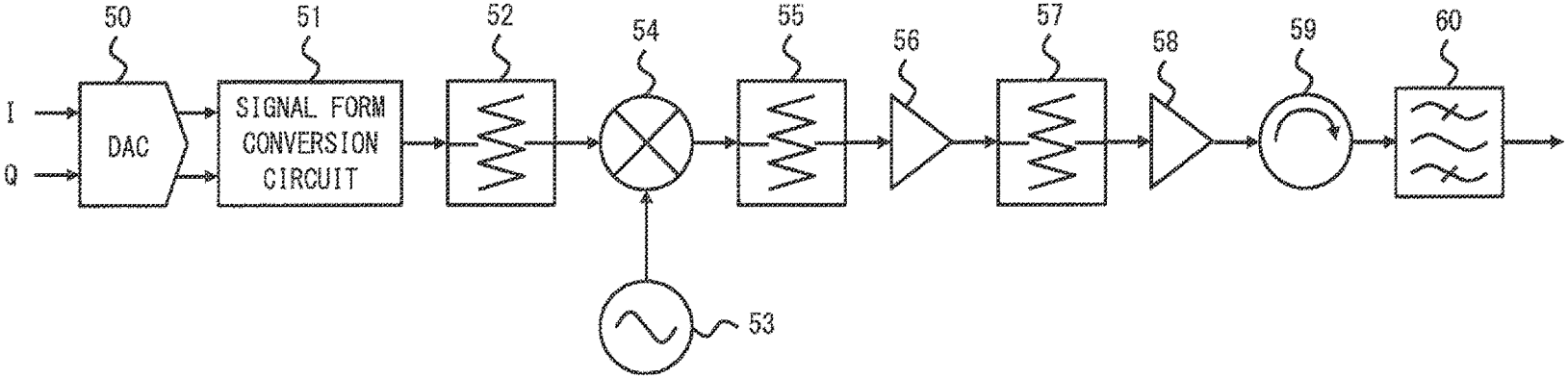
FIG. 22 is a block diagram of a transmitter in accordance with a ninth exemplary embodiment.

In a ninth exemplary embodiment, an example will be explained of configuring a band-pass filter of a transmitter that transmits a radio signal using the dielectric resonator 1 in accordance with the first exemplary embodiment. Consequently, a block diagram of the transmitter in accordance with the ninth exemplary embodiment is shown in FIG. 22. Note that the transmitter shows one example of a functional circuit that is connected to a microstrip wiring and exerts a predetermined function. The present invention is available to a circuit as long as the circuit utilizes a filter circuit configured using the dielectric resonator 1 in accordance with the first exemplary embodiment.

As shown in FIG. 22, the transmitter in accordance with the ninth exemplary embodiment has: a DAC (Digital to Analog Converter) 50; a signal form conversion circuit 51; attenuators 52, 55, and 57; an oscillator 53; a mixer 54; a preamplifier 56; a power amplifier 58; an isolator 59; and a band-pass filter 60.

Figure 23:
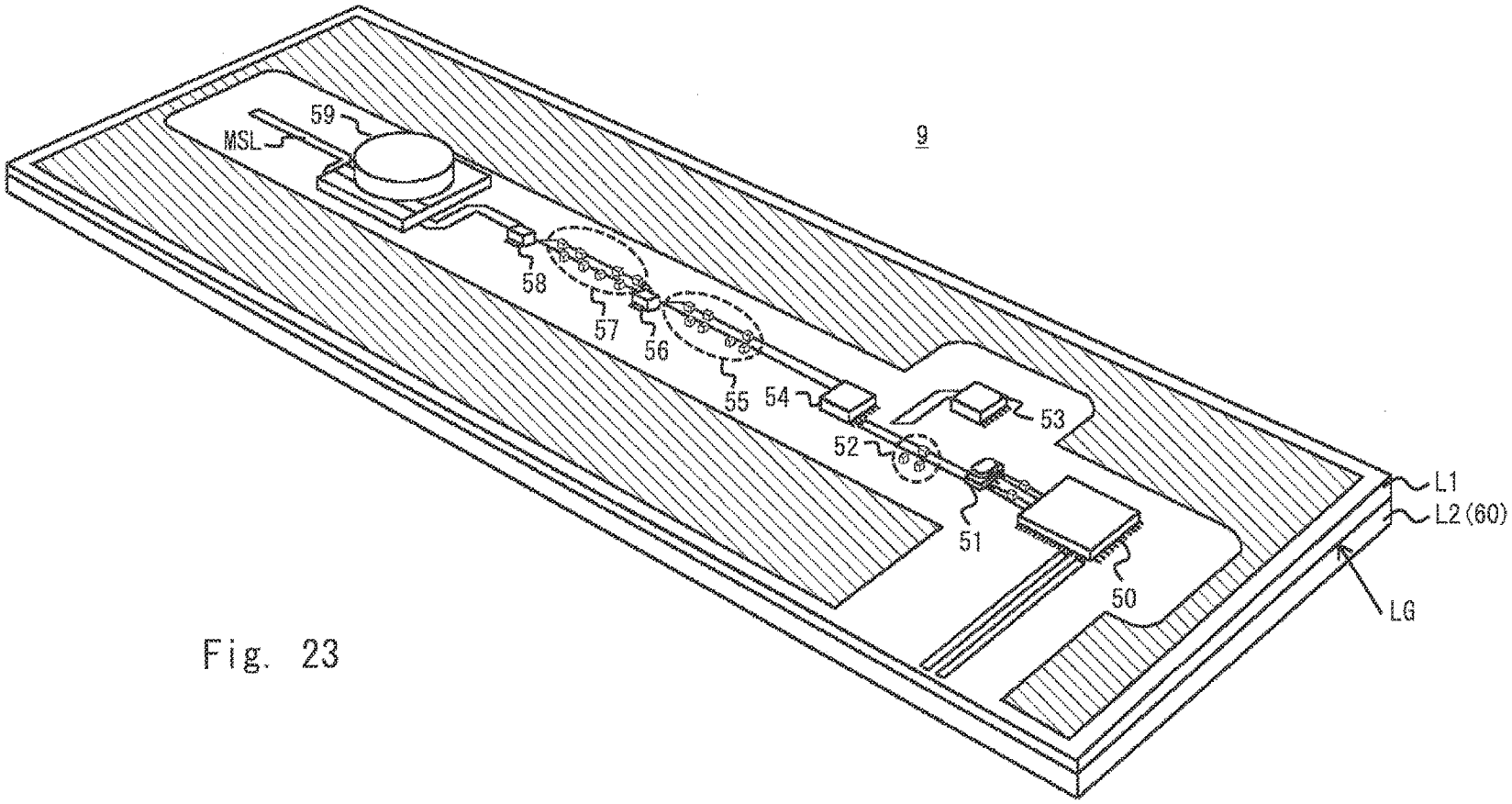
FIG. 23 is a perspective view of the transmitter in accordance with the ninth exemplary embodiment.

The transmitter shown in FIG. 22 converts an I signal and a Q signal into analog signals by digital signals using the DAC 50. At this time, since an output signal of the DAC 50 is a differential signal, the signal form conversion circuit 51 converts the differential signal into a single-ended signal. After the signal is then attenuated by the attenuator 52, a transmission signal is modulated in the mixer 54 using a local signal generated by the oscillator 53. After attenuation processing of the modulation signal is performed in the attenuator 55, the attenuated modulation signal is amplified by the preamplifier 56. The signal amplified by the preamplifier 56 is attenuated by the attenuator 57, is subsequently amplified by the power amplifier 58, and after that, it becomes a transmission signal. Additionally, the transmission signal is transmitted through the isolator 59, the band-pass filter 60, and an antenna (not shown). Note that the isolator 59 prevents a reception signal received by the antenna from leaking to the transmitter side. In addition, the band-pass filter 60 removes noise of the transmission signal. In addition, as shown in FIG. 22, each element configuring the transmitter is connected by a microstrip wiring MSL (FIG. 23).

It becomes possible to form the transmitter including the band-pass filter 60 on one substrate by using the dielectric resonator 1 in accordance with the first exemplary embodiment. Consequently, a perspective view of a transmitter 9 in accordance with the ninth exemplary embodiment is shown in FIG. 23. As shown in FIG. 23, in the transmitter 9 in accordance with the ninth exemplary embodiment, a circuit of the transmitter excluding the band-pass filter 60 is formed on a first substrate L1. In addition, in the transmitter 9 in accordance with the ninth exemplary embodiment, the band-pass filter 60 is formed on a second substrate L2 on which the first substrate L1 is stacked. In addition, a conductor layer LG is formed between the first substrate L1 and the second substrate L2 so as to cover a front surface of the second substrate L2. Note that in an example shown in FIG. 23, although the example is shown where the first substrate on which the circuit of the transmitter excluding the band-pass filter 60 is formed, and the second substrate on which the band-pass filter 60 is formed are stacked, it is also possible to form the transmitter including the band-pass filter 60 on one-layer substrate.

Figure 24:
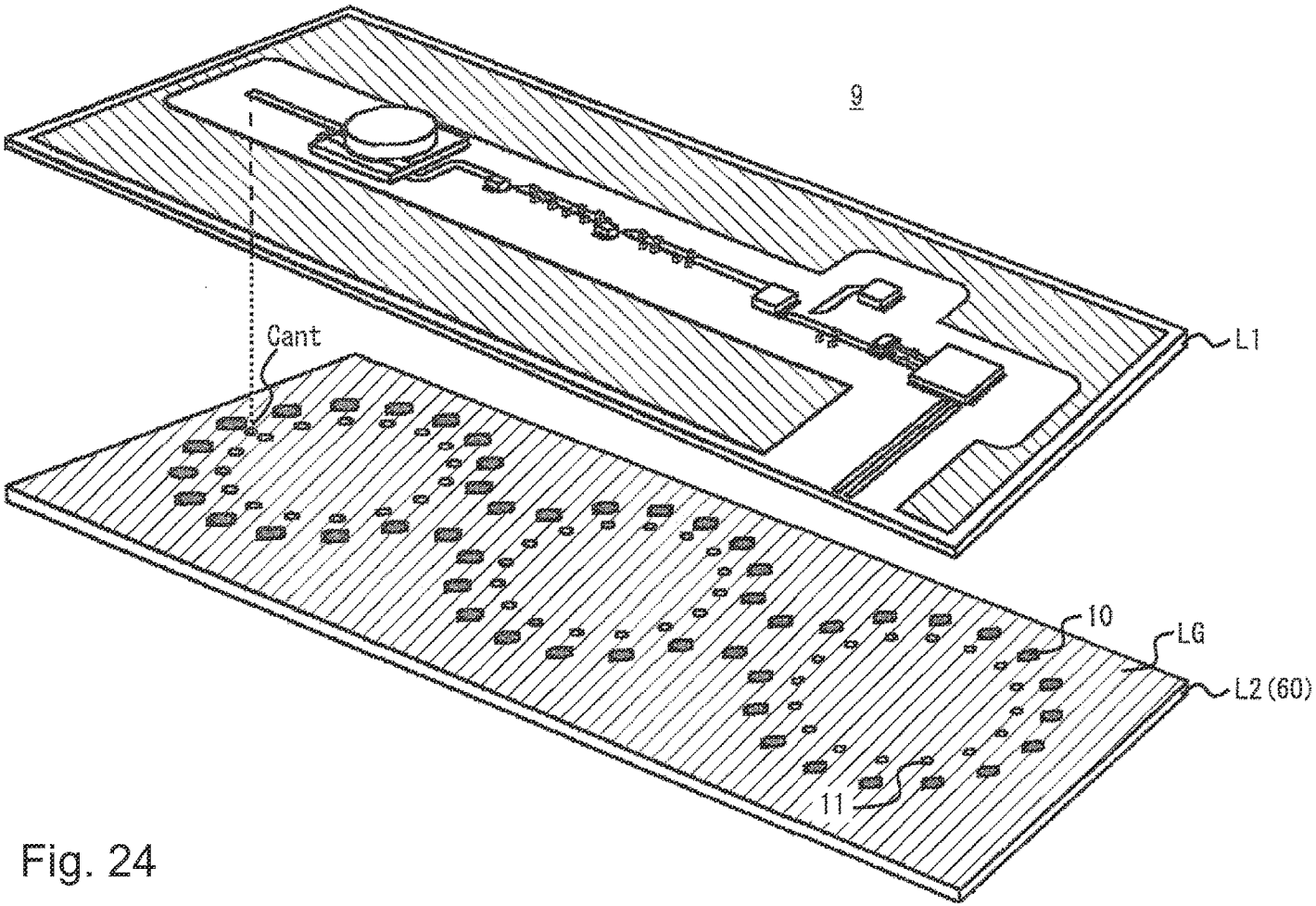
FIG. 24 is a perspective view of a filter of the transmitter in accordance with the ninth exemplary embodiment.

Subsequently, a perspective view of the transmitter 9 in accordance with the ninth exemplary embodiment showing a structure of the second substrate L2 is shown in FIG. 24. As shown in FIG. 24, in the transmitter 9 in accordance with the ninth exemplary embodiment, the band-pass filter 60 in which a plurality of resonance portions are connected by connection portions is formed on the second substrate L2. In addition, as shown in FIG. 24, in the microstrip wiring of the first substrate L1 and the band-pass filter 60, there is formed a coupled antenna Cant formed so as to penetrate the first substrate L1 to reach a resonance portion of an initial stage of the band-pass filter 60 of the second substrate L2. In addition, as shown in FIG. 24, the conductor layer LG is formed on the front surface of the second substrate L2 so as to cover the second substrate L2.

By the above-described explanation, the transmitter 9 can be formed on the multi-layered substrate by using the dielectric resonator 1 in accordance with the first exemplary embodiment. As a result of this, reduction in size and thickness of the transmitter 9 in accordance with the ninth exemplary embodiment can be achieved.

Hereinbefore, although the invention in the present application has been explained with reference to the embodiments, the invention in the present application is not limited by the above. Various changes that can be understood by those skilled in the art within the scope of the invention can be made to configurations and details of the invention in the present application.

This application claims priority based on Japanese Patent Application No. 2013-011297 filed on Jan. 24, 2013, and the entire disclosure thereof is incorporated herein.

REFERENCE SIGNS LIST

1 to 6 dielectric resonator
7 dielectric filter
8 dielectric duplexer
9 transmitter
10 conductive through hole
11 non-conductive through hole
20 substrate
21 and 22 conductor layer
23 dielectric layer
30 and 31 microstrip wiring
32 and 33 coupled antenna
40, 42, and 44 resonance portion
41, 43, and 45 connection portion
50 DAC
51 signal form conversion circuit
52 attenuator
53 oscillator
54 mixer
55 attenuator
56 preamplifier
57 attenuator
58 power amplifier
59 isolator
60 band-pass filter
Cant coupled antenna

The invention claimed is:

1. A dielectric resonator comprising:

a substrate including a first conductor layer, a second conductor layer, and a dielectric layer formed between the first conductor layer and the second conductor layer;

wherein the substrate comprises a plurality of conductive through holes and a plurality of non-conductive through holes that penetrate the substrate and are formed on two circumferences with different diameters respectively, wherein the conductive through holes are formed on an outside circumference of the two circumferences and in which at least side walls of the plurality of conductive through holes are covered with a conductor, and wherein the non-conductive through holes are formed on an inside circumference of the two circumferences, and in which side walls of the plurality of non-conductive through holes are covered with a non-conductor or the dielectric layer is exposed on the side walls of the plurality of non-conductive through holes, wherein the substrate comprises a first substrate that is stacked on a second substrate, a functional circuit is arranged on the first substrate, and a resonance portion formed by the plurality of conductive through holes and the plurality of non-conductive through holes is formed on the second substrate.

2. The dielectric resonator claim 1, wherein the plurality of conductive through holes that penetrate the substrate are formed along a first annular line;

a plurality of resonance portions formed by a respective set of the plurality of conductive through holes and the plurality of non-conductive through holes are formed on the substrate, a first resonance portion and a second resonance portion adjacent to each other among the plurality of resonance portions have respective openings in which the plurality of conductive through holes are not formed, the openings being located in parts of facing regions, and a connection portion connects the opening of the first resonance portion and the opening of the second resonance portion, and in which the plurality of conductive through holes are formed along a first and a second connection line arranged with widths narrower than a width of the first annular line.

3. The dielectric duplexer according to claim 2, wherein a plurality of the dielectric filters are formed on the substrate, and resonance portions of the plurality of resonance portions arranged at a first end of the plurality of dielectric filters each have a coupled antenna connected to one microstrip wiring, and resonance portions of the plurality of resonance portions arranged at a second end of the plurality of dielectric filters each have a coupled antenna connected to a different microstrip wiring.

4. The dielectric resonator according to claim 1, comprising a coupled antenna that is formed in a third region between a first region in which the conductive through holes are formed and a second region in which the non-conductive through holes are formed, and is connected to a microstrip wiring through which a signal is transmitted.

5. The dielectric resonator according to claim 1, wherein the functional circuit that is connected to a microstrip wiring through which the signal is transmitted and executes a predetermined function is connected to the substrate.

* * * * *